US006138822A

United States Patent [19]

Garcia

[11] Patent Number: 6,138,822

[45] **Date of Patent: *Oct. 31, 2000**

[54] CIGARETTE PACKAGING SYSTEM WITH AN ASHTRAY UNIT

[76] Inventor: Guadalupe C. Garcia, 3800 Ararat Ave., Modesto, Calif. 95356

[ * ] Notice: This patent issued on a continued prosecution application filed under 37 CFR 1.53(d), and is subject to the twenty year patent term provisions of 35 U.S.C. 154(a)(2).

[21] Appl. No.: 09/244,349

[22] Filed: Feb. 4, 1999

[51] Int. Cl.[7] ..... A24F 15/00

[52] U.S. Cl. ..... 206/246; 206/256; 206/268; 206/273

[58] Field of Search ..... 206/246, 248, 206/254, 255, 256, 261, 263, 266, 268, 271, 273, 775, 758, 761, 763, 772; 131/231, 238, 239, 235.1, 237

[56] References Cited

U.S. PATENT DOCUMENTS

| | | | |
|---|---|---|---|
| 381,889 | 4/1888 | Scott | 206/248 |
| 1,256,965 | 2/1918 | Williams | 206/261 |
| 1,562,497 | 11/1925 | Derry | 206/246 |
| 2,138,916 | 12/1938 | Gaess | 206/256 |
| 2,349,488 | 5/1944 | Dement . | |
| 2,396,827 | 3/1946 | Card . | |
| 2,944,555 | 7/1960 | Peel et al. . | |
| 2,958,417 | 11/1960 | Adams . | |
| 3,018,877 | 1/1962 | Posavic . | |
| 3,018,878 | 1/1962 | Watkins | 206/246 |
| 3,024,902 | 3/1962 | Taylor | 206/246 |
| 3,090,482 | 5/1963 | Sandacz . | |
| 3,096,878 | 7/1963 | Whitley et al. | 206/246 |
| 4,789,059 | 12/1988 | Kim . | |
| 5,480,025 | 1/1996 | Draucker et al. . | |
| 5,799,781 | 9/1998 | Arthur . | |
| 5,848,595 | 12/1998 | Arthur . | |

FOREIGN PATENT DOCUMENTS

| | | | |
|---|---|---|---|
| 4210959 | 4/1992 | Germany | A24F 15/08 |

*Primary Examiner*—Paul T. Sewell
*Assistant Examiner*—Nhan T. Lam
*Attorney, Agent, or Firm*—Lumen Intellectual Property Service

[57] ABSTRACT

A convenient, safe and economical packaging system for holding elongated smoking members has an open receptacle ashtray that collapses to a reduced closed receptacle container for storing ashes and other smoking debris. An outer sleeve and a container are connected through an accordion section. The accordion section folds by pushing the container into the outer sleeve collapsing the open ashtray receptacle to the closed receptacle. With the container pulled out the open ashtray receptacle is easily assessable through an access hole in the sleeve. the packaging system is particularly useful for packaging cigarettes and can be used several time before emptying the closed receptacle.

16 Claims, 4 Drawing Sheets

CIGARETTE PACKAGING SYSTEM WITH AN ASHTRAY UNIT

FIELD OF THE INVENTION

This invention relates generally to a package for cigarettes having a compartment to hold debris. More particularly, this invention relates to a package for cigarettes with an ashtray compartment that collapses to a concealed compartment for storing cigarette debris such as ashes and filters.

BACKGROUND ART

There several cigarette containers with built-in ash-trays disclosed in prior art. Most of the prior art discloses cigarette containers having pivoting flaps or pivoting members that open and serve as temporary receptacles to hold cigarette debris. For examples of prior art cigarette containers with pivoting ashtray members see; Dement in U.S. Pat. No 2,349,488; Card in U.S. Pat. No. 2,396,827; Peel et al. in U.S. Pat. No. 2,944,555; Adams in U.S. Pat. No. 2,958,417; Posavic in U.S. Pat. No. 3,018,877; Sandacz in U.S. Pat. No. 3,090,482; and Kim in U.S. Pat. No. 4,789,059. The devices disclosed do not serve as permanent receptacles for smoking debris because to close the pivoting ashtray members, the ash-tray must be empty or nearly empty. Thus with each use, the ashtray must emptied prior to storing the container in a pocket or a purse.

Draucker et al. in U.S. Pat No. 5,480,025 discloses a cigarette package to hold short cigarettes using a packages of similar size used to hold conventionally sized cigarettes. The package has a receptacle at the bottom of the package to support the short cigarettes and the receptacle is further supplied with a access aperture that can be used for discarding cigarette ashes and filters. The cigarette package disclosed, however, does not address the potential fire hazards associated with burning cigarette filter or ashes. Further the packages design only provides for a very small access aperture that can easily be used for inserting cigarette filters into the receptacle, but is extremely inconvenient to use as an ash tray during a smoking session.

The German Pat. No. 4210959 discloses a cigarette package with a drawer-like receptacle at the bottom of the cigarette package that can be pulled out and used as an ashtray. After the ashtray is used the drawer be retracted back into the package and stored The ashtray does not require emptying after each use but is not a convenient to use as an ashtray because the receptacle and is very small.

Arthur in U.S. Pat. No. 5,799,781 describes a multi-component cigarette package that contains an ashtray. The package has an outer sleeve and an inner compartment for holding cigarettes, whereby the inner compartment sides into the outer sleeve. The adjustable cavity formed between the bottom of the inner compartment and bottom of the outer sleeve is used as the ashtray. A receptacle hole in a side of the outer sleeve is used to access the cavity when the inner compartment is pulled sufficiently far outward from the outer sleeve. After disposing the smoking debris in the ashtray, the hole is closed by sliding the inner compartment inward into the outer sleeve. This designs provide mechanisms for suffocating burning smoking debris, assuming that the inner section fits in the outer section sufficiently snug to suffocate any smoldering debris and that the inner compartment of the package is inserted far enough into the outer sleeve to completely cover the receptacle hole. However, if the receptacle hole is made large enough to be useful as an ashtray, a small outward displacement of the inter compartment will cause a portion of the receptacle hole to be open and smoking debris will spill out or smoldering debris will re-ignite. This situation is a highly likely since in there is no mechanism to secure the outer section and the inner section in a closed position. Further, since the inside wall of the outer sleeve serves as the bottom of the ashtray it will become highly soiled with ash. After using the ashtray, the inner section is pushed back inward to close the receptacle hole and the outside wall of the inner compartment that overlaps the outer sleeve it will also become soiled with ash. Thus, in a subsequent uses of the ashtray the soiled inner compartment will be pulled out and the hands of the user and the surface where the package is rested will also become soiled. Further, the cigarette container and outer sleeve may become completely separated allowing the smoking debris to escape for the top portion of the outer sleeve.

What is needed is cigarette packaging system that provides an ashtray unit that is functional, safe and clean to use. The ashtray unit needs to be accessible through a large receptacle hole for ashing cigarettes and have a receptacle container for storing smoking debris from several smoking sessions, whereby smoking debris will not cause the packaging system to burn and spillage of smoking debris is unlikely.

OBJECTS AND ADVANTAGES

Accordingly, it is a primary object of the present invention to provide a packaging system for elongated smoking members that has a closed receptacle compartment for storing smoking debris and a larger open receptacle for ashing and disposing of smoking debris.

It is a further object of the invention to provide a packaging system for elongated smoking members that has an open receptacle compartment for disposing smoking debris through a large accesses hole that is easily used for a astray.

It is a further object of the present invention to provide a packaging system for elongated smoking members that has a large open receptacle compartment that compresses to a closed receptacle compartment for permanently storing smoking debris, wherein the smoking debris is secured within closed receptacle and is unlikely to spill or leak-out during storage of the packaging system.

It is a further object of the present invention to provide a packaging system for elongated smoking members that has an open receptacle compartment and closed receptacle compartment that are substantially fire resistant.

It is a further object of the present invention to provide a packaging system for smoking members that has an open receptacle compartment that compresses to a closed receptacle compartment through an accordion member that is attached to a container for holding smoking members and is further attached to an outside sleeve. The accordion member keeps smoking debris contained in the closed receptacle compartment, wherein the accordion member serves as a bottom portion of the ashtray with the system in a open position preventing smoking debris from collecting on the walls of the container after multiple uses.

Lastly, it is an object of the present invention to provide a packaging system for conventional cigarettes, that has an ashtray that is safe, easy to use, clean and can be adapted to conventional cigarette packages already produced by cigarette manufactures.

SUMMARY

The objects and advantages of the invention are accomplished providing a container for holding elongated smoking members. The container has a bottom portion and walls forming a cross-sectional geometry substantially similar to the bottom section of the container and an opening for inserting and storing elongated smoking members. An outer sleeve with a bottom portion, walls and cross-sectional geometry substantially similar the container is inserted over the container and the container is capable of sliding inward within the outer sleeve to a closed position and outward within the outer sleeve to an extended open position. The outer sleeve also has an access hole that is substantially covered by a wall of the container in the closed position and is open to an open receptacle compartment in the expanded open position. The open receptacle compartment is the area within the outer sleeve between the bottom portion of the container and the bottom portion of the sleeve. The container and sleeve are connected by an accordion member that is comprised of at least two hinged sections having geometries substantially similar to the bottom portion of said container. The accordion member is attached to the container and the sleeve, whereby the accordion member unfolds to be substantially flat within the sleeve with the container in the expanded open position and the accordion member is folded and held substantially folded with the container in the closed position. A closed receptacle that is not accessible from the access hole with the container in the closed position is for storing smoking debris. The closed receptacle container is defined as the region between the folded accordion member and the bottom of the sleeve with the container with the container in the closed position.

In a preferred embodiment of the invention the packaging system for elongated smoking members has a substantially rectangular container for holding elongated smoking members and an open end for inserting elongated smoking members. The packaging system also has a substantially rectangular outer sleeve that fits over the container, wherein the container is capable of sliding inward within the outer sleeve to a closed position and outward within the outer sleeve to an extended open position. The outer sleeve has an access hole that is substantially covered by a wall of the container in the closed position and is open to an open receptacle compartment in an extended open position. An accordion members connected near to the bottom of the container and an inside wall of the outer sleeve has at least two rectangular sections with substantially similar geometries to the rectangular bottom of the container. The accordion member unfolds with the container in the expanded open position to be substantially flat against a wall within the sleeve, wherein the substantially flat accordion member serves as a bottom portion of the ashtray. The accordion member is folded and held substantially folded forming a closed receptacle compartment for storing smoking debris with the container in the closed position.

In the most preferred embodiment of the present invention the packaging system is a packaging system for storing cigarettes with an open receptacle ashtray and closed receptacle for storing smoking debris. The cigarette packaging system has a rectangular container made of a material that is preferably 0.25 mm to 2 mm thick. The container has an open end for inserting and storing cigarettes length wise, wherein the container has outside dimensions of 8 to 12 cm long, 4 to 7 cm wide and 1.5 to 3.5 cm deep. The cigarette packaging system has outer rectangular sleeve with inside dimensions similar to the outside dimensions the container and an open end for inserting the container. The container is capable of sliding inward within the outer sleeve to a closed position and outward within said outer sleeve to an extended open position. The outer sleeve has an access hole that is covered by the container in the closed position and is open to an open receptacle ashtray in the extended open position. An accordion members is made of rectangular sections and is attached to a portion of the container and a wall of said sleeve and prevents the container from being removed from the sleeve. The accordion member is substantially flat with the container in the extended open position and against a wall opposite of the access hole. the accordion member serves as a bottom portion of the open receptacle ashtray with the container in the extended open position and is folded in the closed position forming a closed receptacle for storing smoking debris.

The container, the sleeve and the accordion member are preferably constructed of cardboard for easy recycling/disposable, but are also made of metal or other material that is capable of being reused. Further, it is preferred that the interior surfaces accessible to smoking debris within the closed receptacle compartment and the open receptacle ashtray are cover with a fire resistant material including a metal coatings and a fiber glass coatings.

The access hole for ashing and disposing of smoking debris can be any shape, but is preferably round and large enough to be used as a functional ashtray. In the most preferred embodiment of the invention the access hole is on the larger side of the rectangular sleeve and opposite to the bottom of the open ashtray receptacle, but is can also be on the smaller rectangular side of the sleeve without loss to the benefits of the packaging system, except that the access hole can not be as large. In a further embodiment the access hole has an attached lid, but a lid is not required to keep smoking debris contain in the closed receptacle because the access hole is closed with the container in the closed position and thus containing the stored debris.

The invention also preferably has a top to hold the smoking members in the container and a means to secure the container in the closed position to contain the stored smoking debris. In a preferred embodiment of the invention the smoking member are secured in the container by a flip-top. In a particular embodiment of the invention the a flip-top is attached to the sleeve and serves to contain the smoking members in the container and to secure the container in the closed position within the sleeve. Additionally, the packaging system further has a pouch for holding a lighter or a book of matches.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiment of the invention is set forth without any loss of generality to, and without imposing limitations upon, the claimed invention.

Figure 1A:
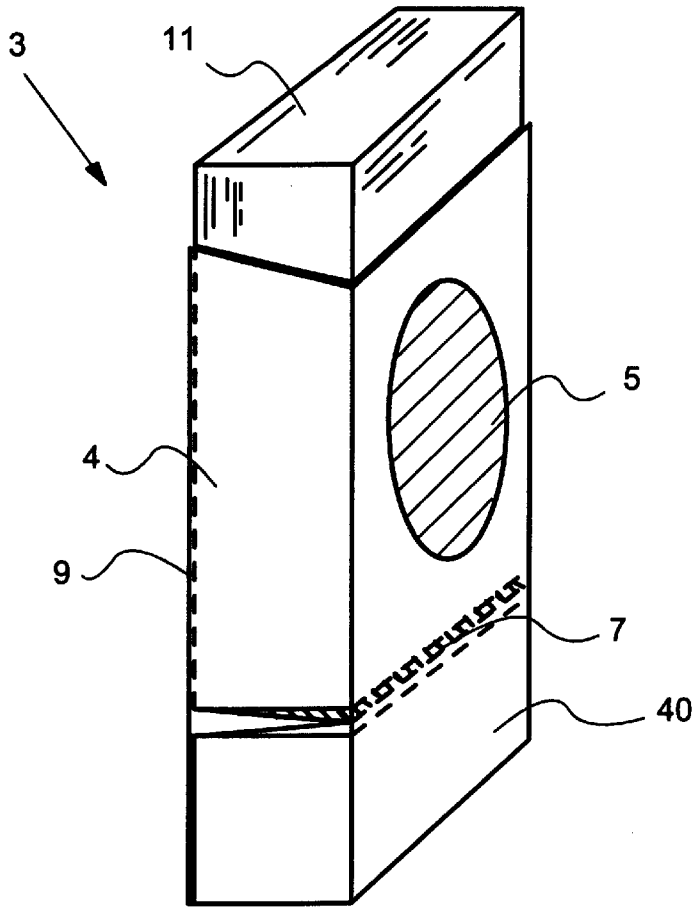
FIG. 1*a* is a cigarette packaging system according to the invention with the cigarette container in the closed position.
Figure 1B:
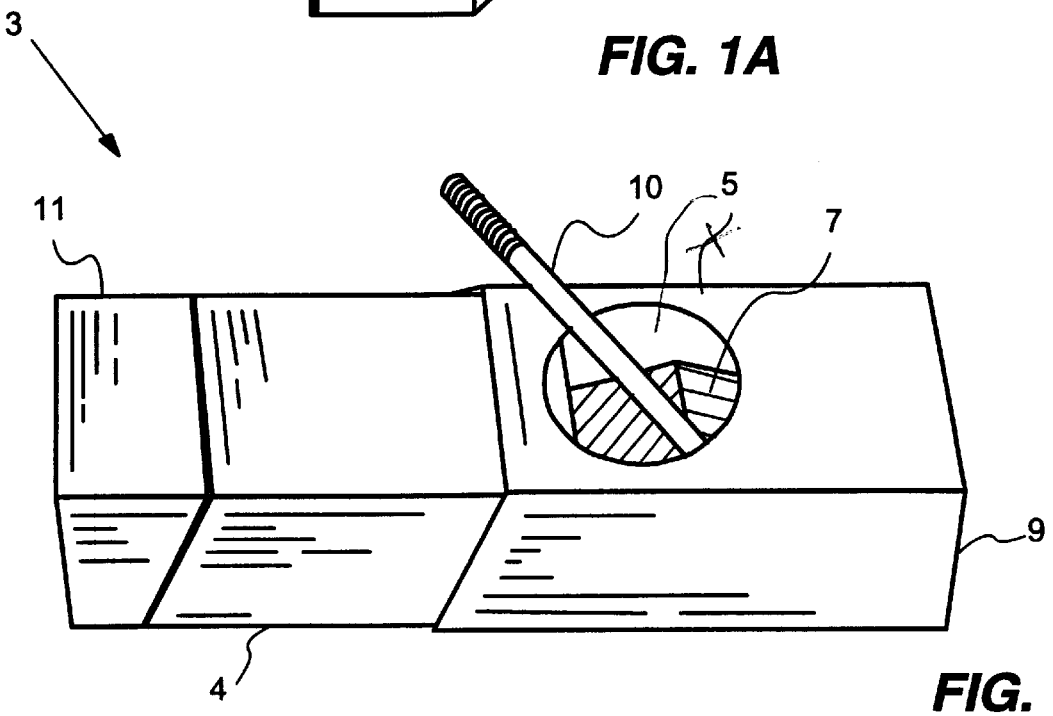
FIG. 1*b* is a cigarette packaging system according to the invention with the cigarette container in the open position with showing the open receptacle compartment being used as an ashtray.

A preferred embodiment of the invention is shown in FIG. 1. The packaging system 3 of the invention that is capable of forming an open ashtray receptacle that compresses to a closed receptacle for storing smoking debris is preferably a packaging system for cigarettes, but is suitable for packaging any elongated smoking member. In fact, the packaging system is well suited for packaging any tobacco related smoking product that may require and ashtray and a receptacle for storing smoking debris. The packaging system 3 preferably has a rectangular cigarette container 4 that is positioned inside a outer rectangular sleeve 9. In a most particular embodiment of this invention the cigarette container is a standard cigarette box with a flip-top lid. The outer rectangular sleeve 9 has inside dimensions similar to the outside dimensions the container 4, wherein the container 4 is capable of sliding inward within the outer sleeve 9 to a closed position as shown in FIG. 1. The outer sleeve has an access hole 5 that is covered by a portion of the container 4 in the closed position. The packaging system 3 further comprises an accordion member 7 that has at least two rectangular sections having substantially similar in geometry to the bottom portion of the container. The accordion member is 7 is connected to the container 4 and the sleeve 9 and is substantially folded within the sleeve 9 with the container 4 in the closed position. A portion of the accordion member 7 and the bottom of the sleeve form a closed receptacle container 40 for storing smoking debris with the container 4 in the closed position. In a particular embodiment of the current invention the outer sleeve 9 has a cover member 8 for covering the access hole 5 when the ashtray is not in use and a pouch 6 for holding a lighting device.

Now referring to FIG. 2, the container 4 is capable of extending outward within the outer sleeve 9 to an extended open position as shown. In the open position, the access hole 5 is open to an open ashtray receptacle and is used for ashing and resting a smoking member including a cigarette 10. The accordion member 7 is substantially flat with the container 4 in the extended open position, and in the preferred embodiment of the invention, is substantially against a wall of the sleeve 9 opposite of the access hole 5, wherein the accordion member 7 serves as a bottom portion of the open receptacle ashtray. When the smoker is finished smoking a cigarette 10, for example, the filter and ashes are left in the open ashtray receptacle and the container is returned to the closed position shown in FIG. 1, wherein the smoking debris is enclosed in the closed receptacle container 40.

Again referring to FIG. 1*b*, because the accordion member 7 serves as a bottom portion of the ashtray, the outer sleeve 9 is not soiled with ashes when the container 4 is returned to the closed position after smoking and, therefore, will not soil the users hands or other surfaces that the packaging system may come in contact with after multiple uses. Further, in a preferred embodiment, the inside portions of the outer sleeve 9, the exposed surface of the accordion member 7 and the bottom of the container 4 that form the open and closed receptacle compartments are coated with a fire resistant material. The fire resistant material is preferably a thin layer of metal but can also be fiber glass any material that provides protection against fire during use of the packaging system.

Figure 2A:
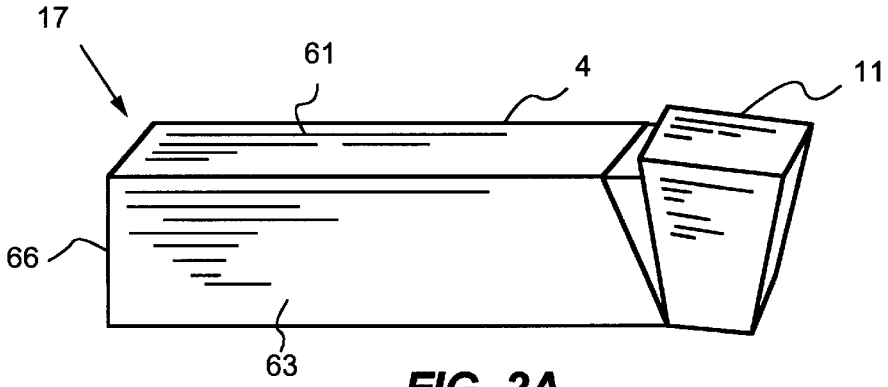
FIG. 2*a* is a standard cigarette package with a flip-top used as a container in the invention.
Figure 2B:
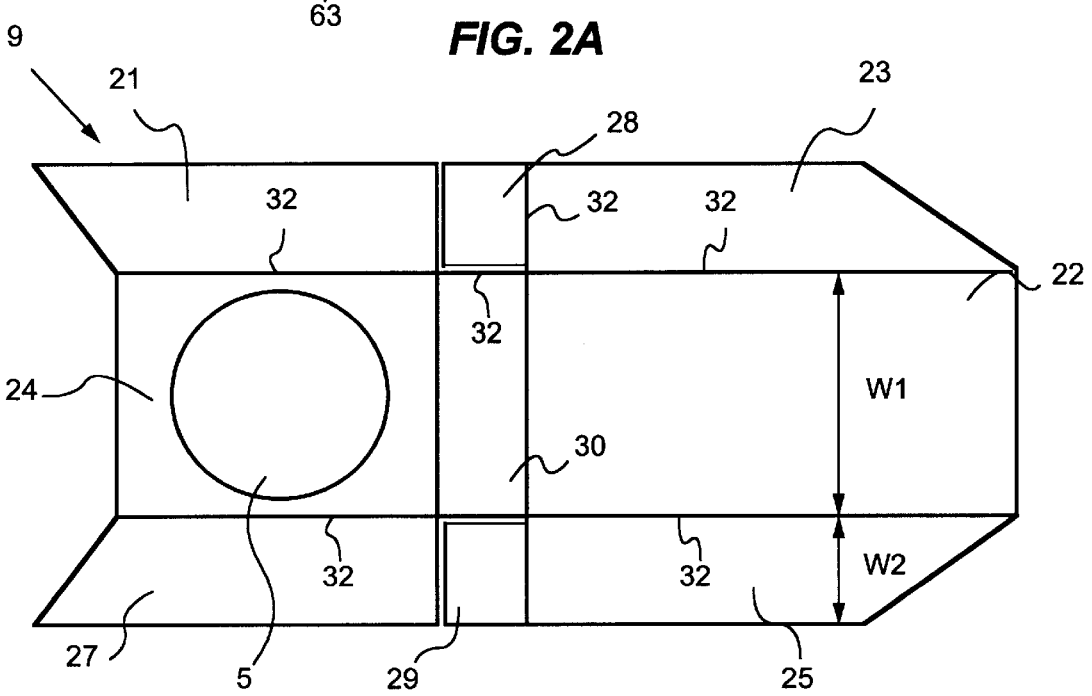
FIG. 2*b* is an unfolded portion of the outer sleeve used in the cigarette packaging system of the invention.

FIGS. 2*a*–2*d* show the individual unassembled components of a preferred embodiment of the invention. FIG. 2 is a cigarette box 17 that is any typical cigarette box or standard manufactured cigarette package, but is preferably constructed from cardboard. Typically, the cigarettes that are manufacture and packaged with a cardboard container also have a flip-top 11 to hold cigarettes in the container 4. FIG. 2*b* is a flat member 9 that has been cut (as illustrated in FIG. 2*b*) preferably from a piece of card board (not shown) that is capable of being glued on the flaps 21, 23 25, 27, 28, 29 and folded on the lines 32 to form the outer sleeve of this invention. A side of the member 9 , that is the interior of the outer sleeve, is preferably coated with a fire resistant material either prior to cutting the member 9 or after cutting the member 9. It is particularly useful to coat the member 9 using a metallic adhesive tape, but the flat member 9 can be coated with a fire resistant material by any suitable method.

The larger sides 24 and 22 have substantially similar widths W1 to a larger rectangular side 63 of the cigarette box 17 and the flaps have substantially similar widths W2 to a smaller rectangular side of the cigarette box as shown in FIG. 2*a*, but are generally slightly larger so that when the outside sleeve is formed form the member 9 the box 17 will easily slide inside. Further, the bottom section 30 of the member 9 has a similar size and geometry to that of the bottom 66 of the cigarette box 17.

Figure 2C:
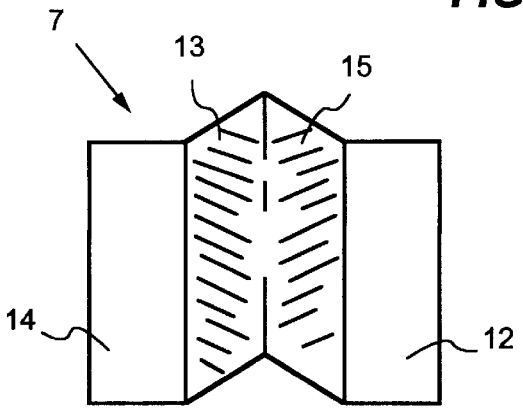
FIG. 2*c* is an exemplary accordion member used in the cigarette packaging system of the current invention.

FIG. 2*c* illustrates an accordion member 7 prior to its assembly into the packaging system of this invention. The accordion member 7 has two rectangular sections with substantially the same size and geometry as the bottom 66 of the box 17, shown in FIG. 2*a*. Again referring to FIG. 2*c*, the flaps 14 and 12 are used as support surfaces to attach the accordion member 7 to the wall 22 of the member 9 and the container 4. The sections 12 and 14 are preferably made form a cardboard material coated with a fire resistant material on at least one side, namely, the side that serves as a bottom portion of the open ashtray receptacle (corresponding to the back side of the accordion member 7 as shown in FIG. 2*c*). It is convenient to coat the accordion member 7 with a fire resistant metallic tape wherein the tape extends beyond the accordion sections 13 and 15 to form the flaps 12 and 14. The adhesive of the metallic tape that form the flaps 12 and 14 provides a means to attach the accordion member 7 to the bottom 66 of box 17 and the wall 22 of the member 9, while providing a fire resistant coating to the bottom 66 of the box 17. It is clear, however, that the accordion sections 13 and 15 can be attached to the outer sleeve and the container by several alternative means.

Figure 3:
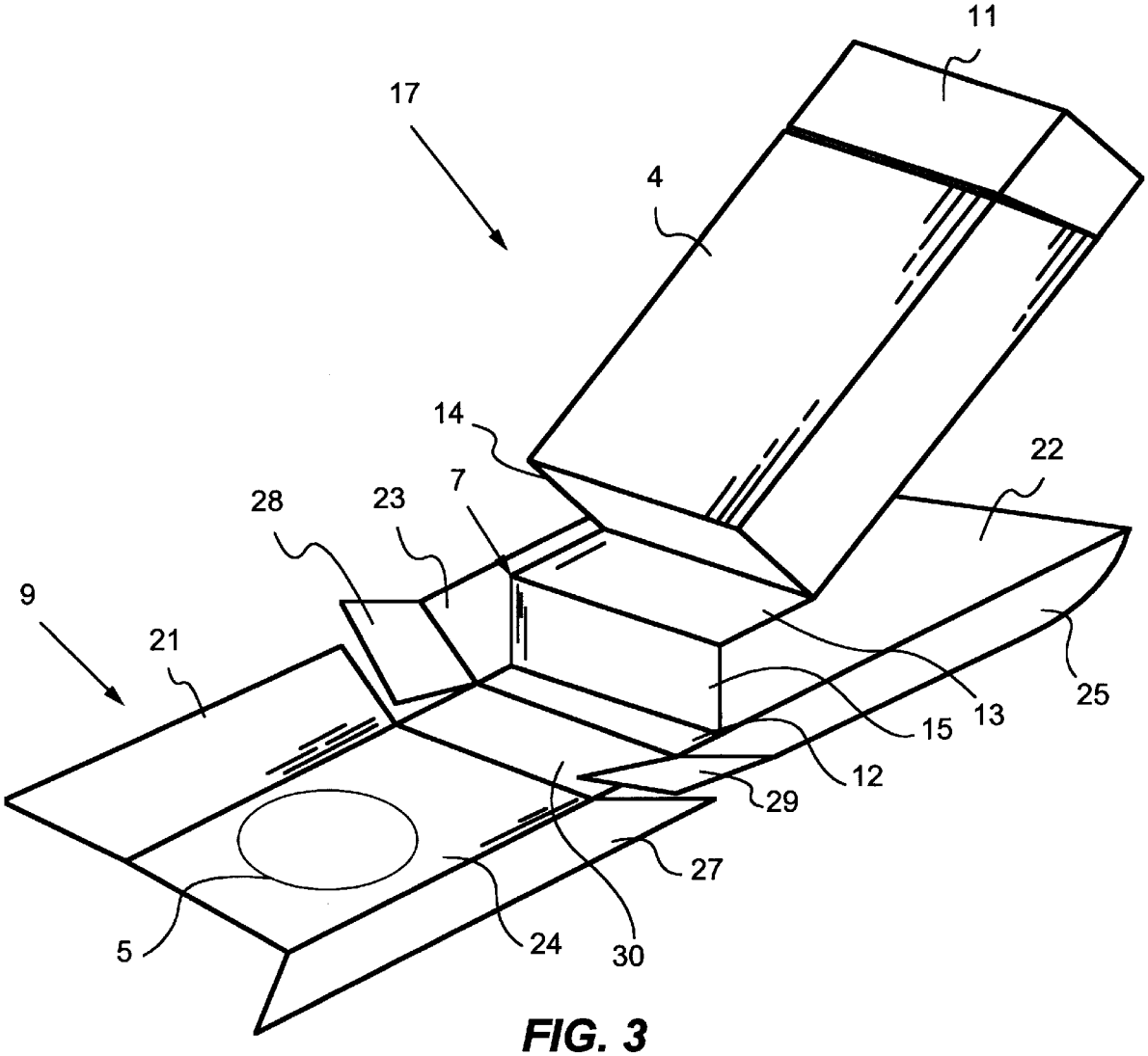
FIG. 3 is a view of a partially assembled cigarette packaging system of the invention.

FIG. 3 illustrates a partially assembled cigarette packaging system 17 of the current invention. The flap 14 of the accordion member 7 is attached to the bottom of the container 17 as shown and the flap 12 is attached to a wall 22. Adhesive is applied to selected surfaces of the flaps 21, 23 25, 27, 28, 29 in order to assemble the sleeve. The member 9 is fold to form a complete packaging system previously represented in FIG. 1*a*.

Figure 4A:
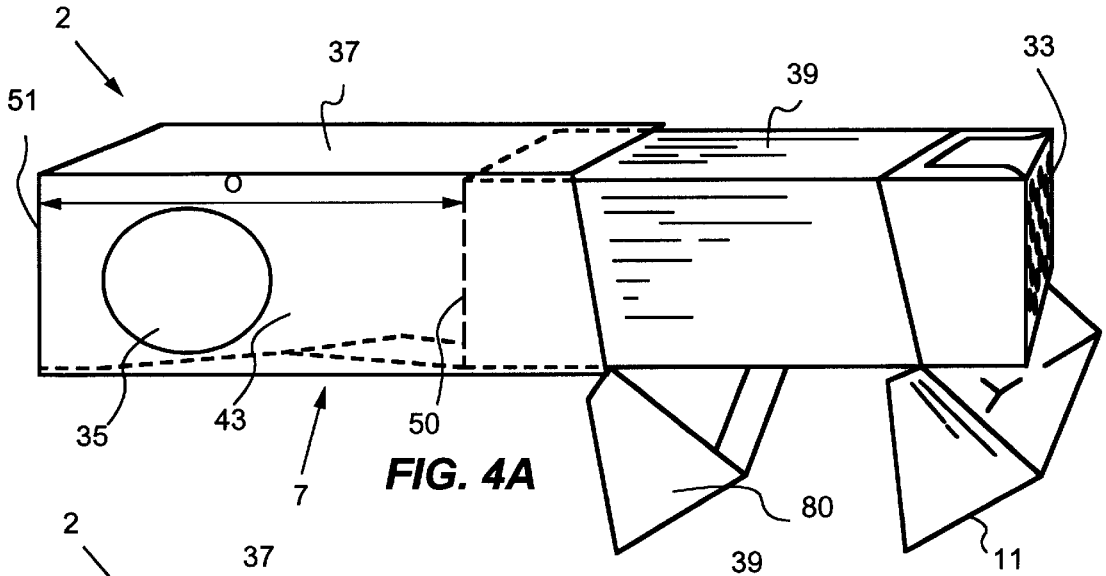
FIG. 4*a* is a cigarette packaging system according to the invention with the cigarette container in an extended open position and the access hole, on a smaller rectangular side of the outer sleeve, open to the open ashtray receptacle.
Figure 4B:
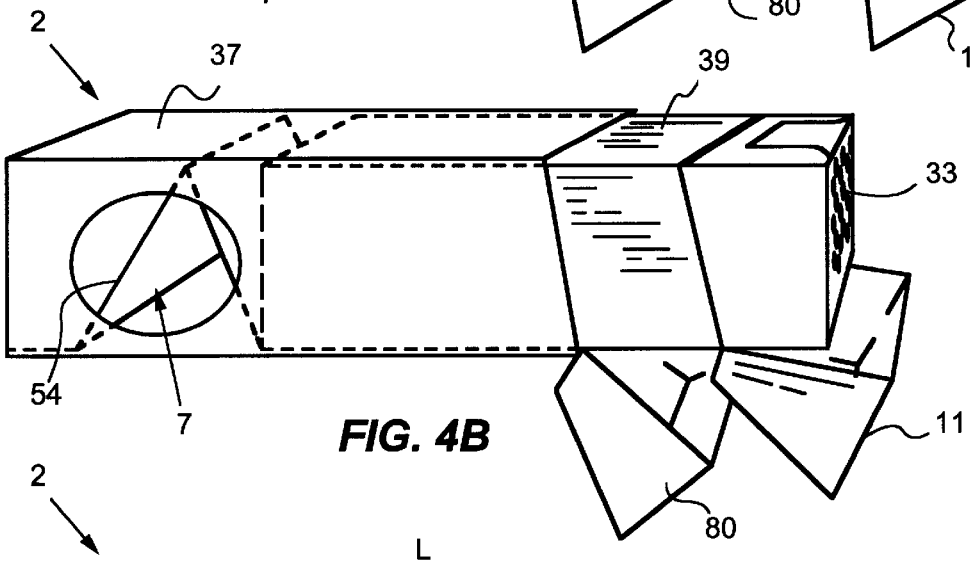
FIG. 4*b* is a cigarette packaging system according to the invention with the cigarette container in a position between an extended open position and a closed position to illustrate the positioning and motion of the accordion member.
Figure 4C:
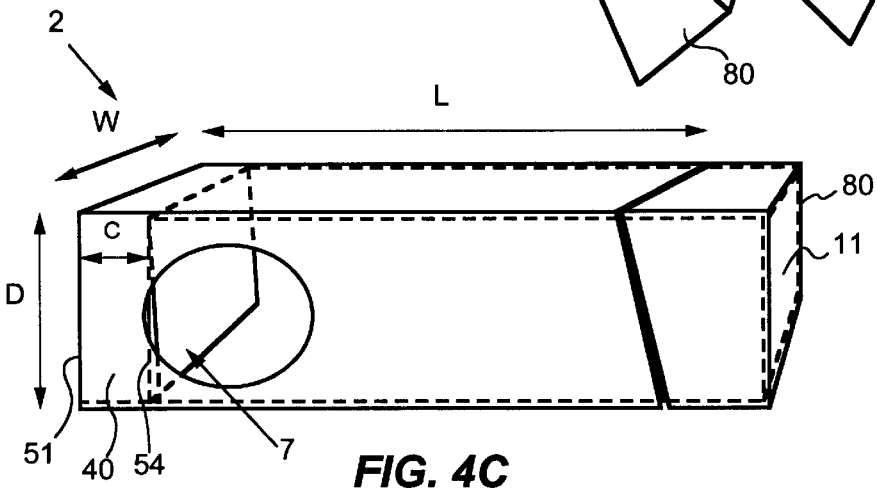
FIG. 4*c* is a cigarette packaging system according to the invention with the cigarette container in a closed position and with a flip top attached to the outer sleeve to secure the cigarette container in the closed position.

FIG. 4*a*–*c* show further embodiments, particulars and adaptations of the packaging system. Further, the FIGS.

4*a*–4*c* clearly illustrates the motion and positioning of the accordion member 7 as the cigarette container 39 is move in or out of the outer sleeve 37. Referring to FIG. 4*a*, the container 39 is in the extended open position (O), wherein the access hole 35 is open to the open ashtray receptacle 43 defined by the area within that outer sleeve 37 that is between the bottom 50 of the container 39 and the bottom 51 of the sleeve 37. The accordion member 7 is in a substantially flat position within the sleeve 37 and serves as a bottom portion of the open ashtray receptacle 43.

FIG. 4*b* illustrates the position of the accordion member within the outer sleeve 37 when the container 39 is between the extended open position and the closed position. In FIG. 4*c* the container is in the closed position (C) and the accordion member 7 is folded. The surface 54 of the accordion member 7 and the bottom 51 of the outer sleeve 37 form the closed receptacle 40 for storing smoking debris. The outer sleeve 37 also has a flip-top 80 that capable of being closed over the flip-top 11 of the container 39 in order to secure the container 39 in the closed (C) position. The flip-top 11 is unnecessary in this embodiment, as it is clear the flip-top 80 will serve both purposes of holding smoking members in the container 39 and securing the container 39 in the closed position within the outer sleeve 37. Again referring to FIG. 4*a*, in a most preferred embodiment of the invention the cigarette packaging system 2 is made from a material that is preferably 0.25 mm to 2 mm thick and is cardboard. The outside dimension of the of the cigarette container 39 are 8 to 12 cm long (L), 4 to 7 cm wide (W) and 1.5 to 3.5 cm deep (D). The cigarette packaging system 2 has outer rectangular sleeve 37 with inside dimensions similar to the outside dimensions the container 39 within the tolerances of +/−0.5 cm.

It will be clear to one skilled in the art that the above embodiment may be altered in many ways without departing from the scope of the invention. For example, the container 39 can be held in the closed position by any means such as a strap, and while the access hole is preferably round any shape is within the scope of the invention. Further, the cigarette packaging system is easily equipped with a pouch for holding a lighter or a book of matches. Accordingly, the scope of the invention should be determined by the following claims and their legal equivalents.

What is claimed is:

1. A packaging system for holding smoking members said system having an open ashtray receptacle for dispensing smoking debris and a closed receptacle for storing said smoking debris, said system comprising:

a) an outer sleeve comprising a front sleeve wall, a back sleeve wall, two side sleeve walls, and a sleeve bottom connecting adjacent ends of said front sleeve wall, said back sleeve wall and said two side sleeve walls, said front sleeve wall having an access hole for dispensing of said smoking debris through, said access hole being positioned a distance from said sleeve bottom to provide space for said closed receptacle;

b) a container for holding said elongated smoking members said container comprising a front container wall, a back container wall, two side container walls and a container bottom connecting adjacent ends of said front container wall, said back container wall and said two side container walls, said container being capable of slidably extending from said sleeve to a open position such that said access hole is open to said open ashtray receptacle between said sleeve bottom and said container bottom, said container also being capable of slidably retracting within said sleeve to a closed position and stopping to a distance away from said sleeve bottom such that, said access hole is completely closed by a portion of said front container wall;

c) an accordion member positioned within said sleeve between said sleeve bottom and said container bottom, wherein a surface of the accordion member and the sleeve bottom form the closed receptacle, said accordion member comprising at least two folding sections connected along a folding edge and first and second flaps, each said folding section having a geometry substantially similar to said sleeve bottom and said container bottom, said accordion member being attached to said back sleeve wall by a first flap at a distance from said sleeve bottom such that said container is prevented from being retracted farther than where said accordion member is attached, of said accordion being attached to said container bottom by a second flap such that said accordion member is flattened to serve as an ashtray bottom with said container in said extended open position and said container is prevented from being removed from said sleeve;

wherein smoking debris received on said accordion member when said sleeve is in said open position is entirely contained within said closed receptacle when said sleeve is in said closed position.

2. The packaging system of claim 1 wherein said sleeve, said container and said accordion member comprise cardboard.

3. The packaging system of claim 2 wherein inside surfaces of said sleeve and surfaces of said accordion member are covered with a fire resistant material.

4. The packaging system of claim 3 wherein said fire resistant material is selected from the group consisting of a metal and fiberglass.

5. The packaging system of claim 1 wherein said container further comprises a flip-top attached to at top portion of said container for securing said smoking members.

6. The cigarette packaging system of claim 1 further comprising a means to secure said container in said closed position.

7. The cigarette packaging system of claim 6 wherein said means to secure said container in said closed position is a flip-top connected to a top edge of said sleeve.

8. The cigarette packaging system of claim 1 wherein said distance at which said accordion is attached to said back sleeve wall is greater than 0.5" from said sleeve bottom.

9. The cigarette packaging system of claim 8 further comprising a means to secure said container in said closed position.

10. The cigarette packaging system of claim 9 wherein said means to secure said container in said closed position is a flip-top connected to a top edge of said sleeve.

11. A packaging system for holding smoking members said system having an open ashtray receptacle for dispensing smoking debris and a closed receptacle for storing said smoking debris, said system comprising:

a) an outer sleeve comprising a front sleeve wall, a back sleeve wall, two side sleeve walls, and a sleeve bottom connecting adjacent ends of said front sleeve wall, said back sleeve wall and said two side sleeve walls, at least one of said side sleeve walls having an access hole for dispensing of said smoking debris, said access hole positioned a distance from said sleeve bottom to provide space for said closed receptacle;

b) a container for holding said elongated smoking members said container comprising a front container wall, a back container wall, two side container walls and a container bottom connecting adjacent ends of said front container wall, said back container wall and said two side container walls, said container being capable of slidably extending from said sleeve to a open position such that said access hole is open to said open ashtray receptacle, said container also being capable of slidably retracting within said sleeve to a closed position within said outer sleeve to a distance away from said sleeve bottom such that, said access hole is completely closed by a portion of a corresponding side container wall;

c) an accordion member positioned within said sleeve between said sleeve bottom and said container bottom, wherein a surface of the accordion member and the sleeve bottom form the closed receptacle, said accordion member comprising at least two folding sections connected along a folding edge and first and second flaps, each said folding section having a geometry substantially similar to said sleeve bottom and said container bottom, said accordion member being attached to said back sleeve wall by said first flap at a distance from said sleeve bottom such that said container is prevented from being retracted farther than said position where said accordion member is attached, said accordion being attached to said container bottom by said second flap such that accordion member is flattened along said back sleeve wall to serve as an ashtray bottom with said container in said extended open position and said container is prevented from being removed from said sleeve; wherein smoking debris received on said accordion member when said sleeve is in said open position is entirely contained within said closed receptacle when said sleeve is in said closed position.

12. The packaging system of claim 11 wherein said sleeve, said container and said accordion member comprise cardboard.

13. The packaging system of claim 12 wherein inside surfaces of said sleeve and surfaces of said accordion member are covered with a fire resistant material.

14. The packaging system of claim 13 wherein said fire resistant material is selected from the group consisting of a metal and fiberglass.

15. The packaging system of claim 11 wherein said container further comprises a flip-top attached to at top portion of said container for securing said smoking members.

16. The cigarette packaging system of claim 11 wherein said distance at which said accordion is attached to said back sleeve wall is greater than 0.5" from said sleeve bottom.

* * * * *